US005798500A

United States Patent [19]

Stillwagon, Jr. et al.

[11] Patent Number: 5,798,500

[45] Date of Patent: Aug. 25, 1998

[54] CURLING IRON STOVE WITH INTERNAL CAVITY WITH ELECTRIC HEATER POSITIONED THEREBELOW

[76] Inventors: Ross I. Stillwagon, Jr.; Fernando Fischbach, both of 13033 Park St., Santa Fe Springs, Calif. 90670

[21] Appl. No.: 538,184

[22] Filed: Aug. 23, 1995

Related U.S. Application Data

[63] Continuation-in-part of Ser. No. 103,987, Aug. 10, 1993, abandoned.

[51] Int. Cl.[6] ..... H05B 3/00

[52] U.S. Cl. ..... 219/242; 219/521; 219/385

[58] Field of Search ..... 219/242, 222–226, 219/385, 386, 406, 407, 390, 521; 34/202

[56] References Cited

U.S. PATENT DOCUMENTS

| | | | |
|---|---|---|---|
| 1,101,527 | 6/1914 | Denhard | 219/242 X |
| 1,481,065 | 1/1924 | Opperman | 219/390 X |
| 1,516,970 | 11/1924 | Kiger | 219/242 |
| 1,530,199 | 3/1925 | Opperman | 219/386 X |
| 1,562,349 | 11/1925 | Lorenze et al. | 219/242 |
| 1,567,878 | 12/1925 | Van Tine | 219/521 |
| 1,589,102 | 6/1926 | Brandstetter | 219/521 |
| 1,687,858 | 10/1928 | Curtis | 219/521 |
| 2,035,757 | 3/1936 | Ottenstein | 219/407 |
| 2,268,686 | 1/1942 | Weekes | 219/521 |
| 2,651,703 | 9/1953 | Atkins | 219/521 |
| 2,724,765 | 11/1955 | Braxter | 219/242 |
| 2,793,278 | 5/1957 | Anderson et al. | 219/521 |
| 3,946,196 | 3/1976 | Waters et al. | 219/242 X |
| 4,103,145 | 7/1978 | Oliveri | 219/222 |
| 4,803,341 | 2/1989 | Barowski et al. | 219/222 |

*Primary Examiner*—John A. Jeffery
*Attorney, Agent, or Firm*—Ronald Juniper

[57] ABSTRACT

A stove for heating curling irons which is characterized by having an internal cavity member to receive irons, a case with an especially compact, attractive shape, a tubular heater (with controller) positioned therebelow to very efficiently heat irons placed in the cavity member, and insulation within the case sufficient to prevent the exterior thereof being hot enough to burn a user. The heater is essentially only adjacent to curling irons to be heated and remotely displaced from the outer surface areas of the case likely to be touched.

3 Claims, 2 Drawing Sheets

FIG. 1
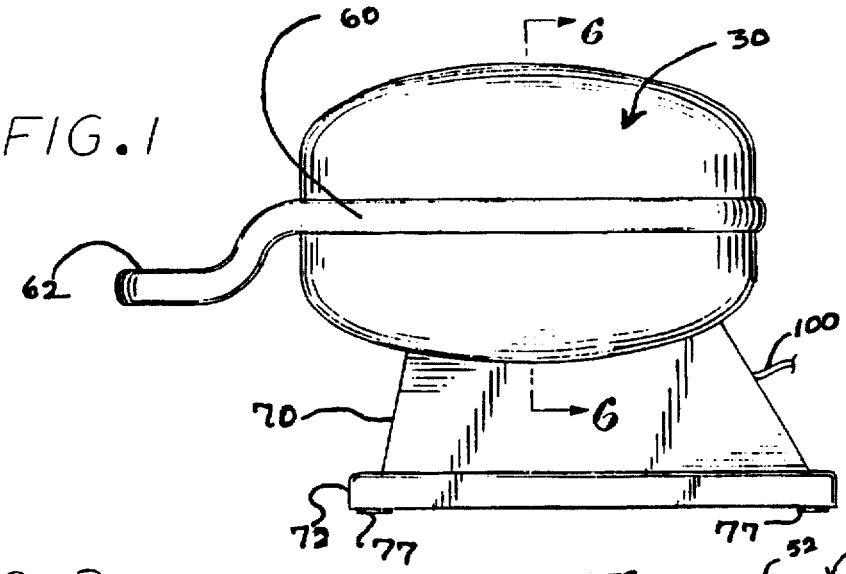
FIG. 2
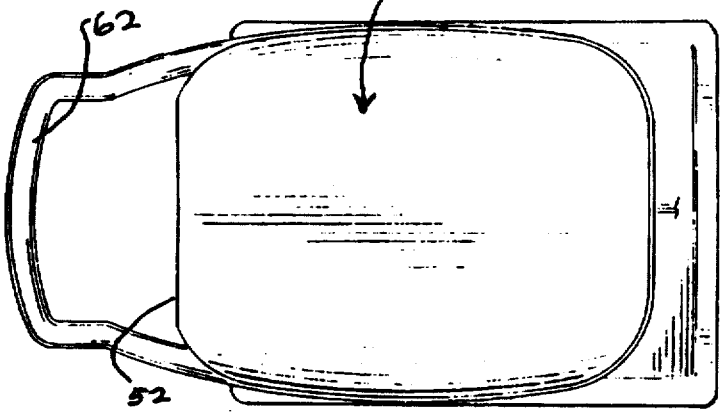
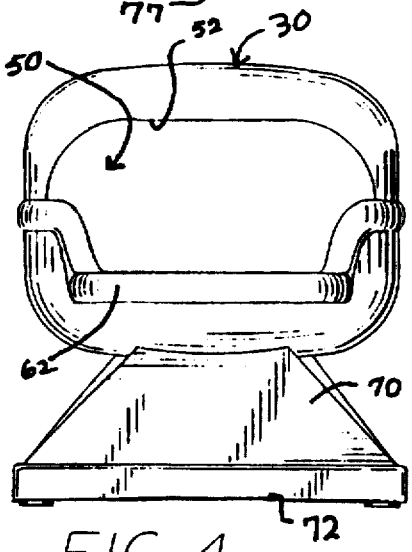
FIG. 4
FIG. 3
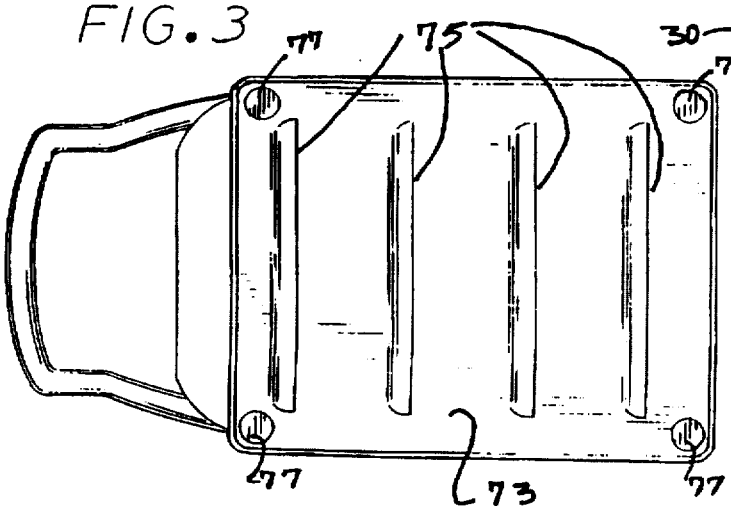
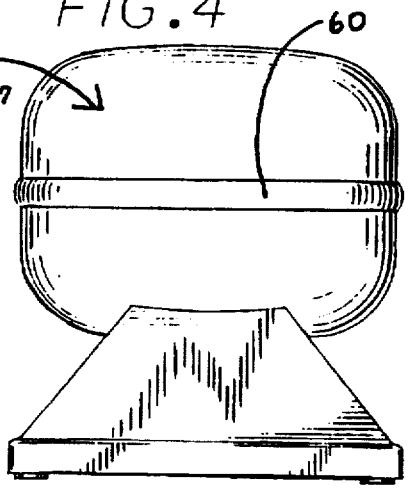
FIG. 5

FIG. 6
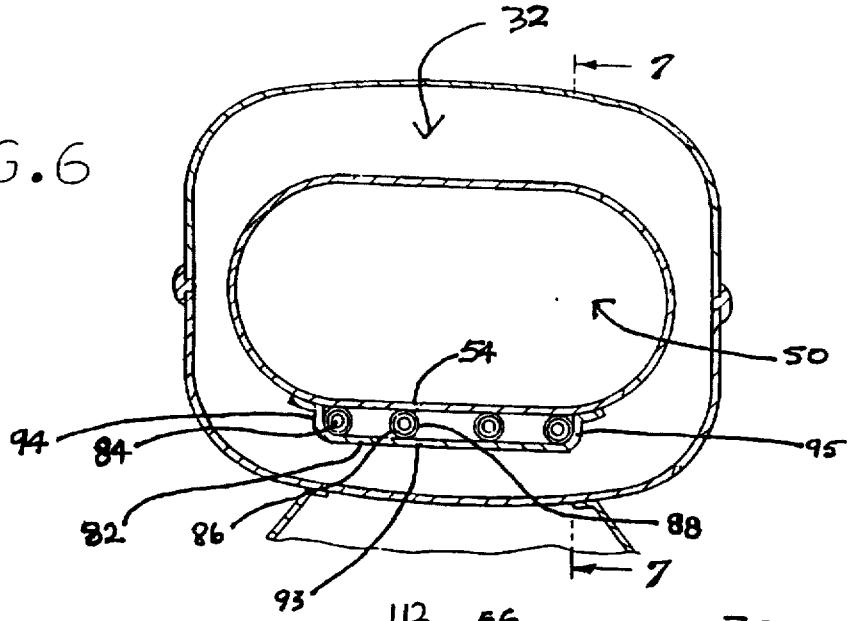
FIG. 7
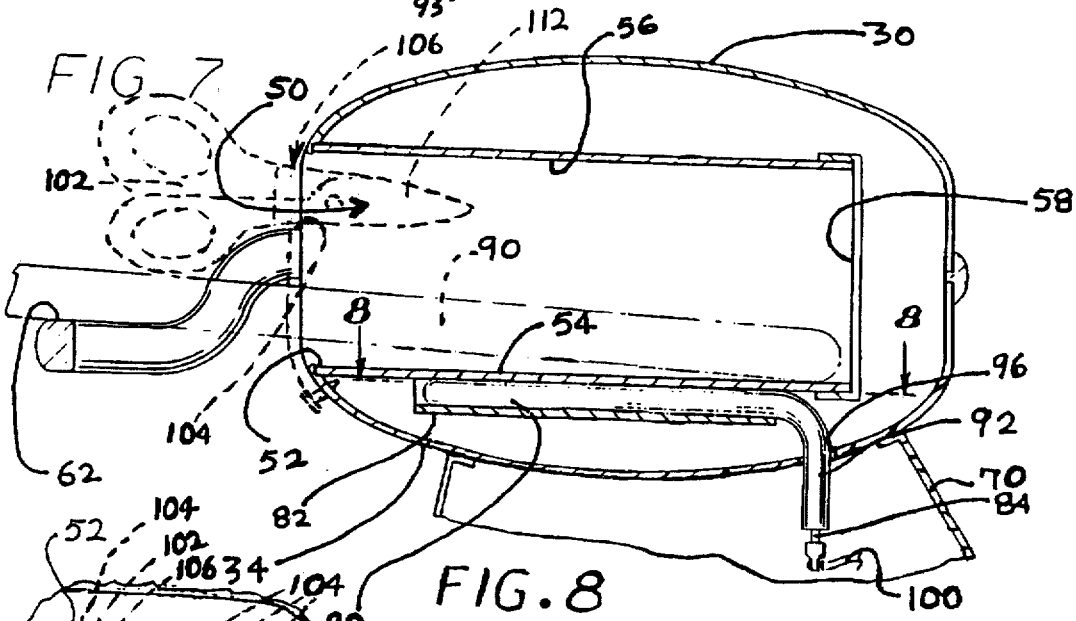
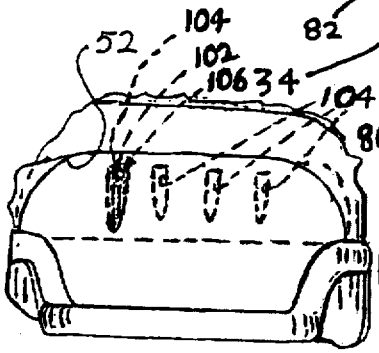
FIG. 8
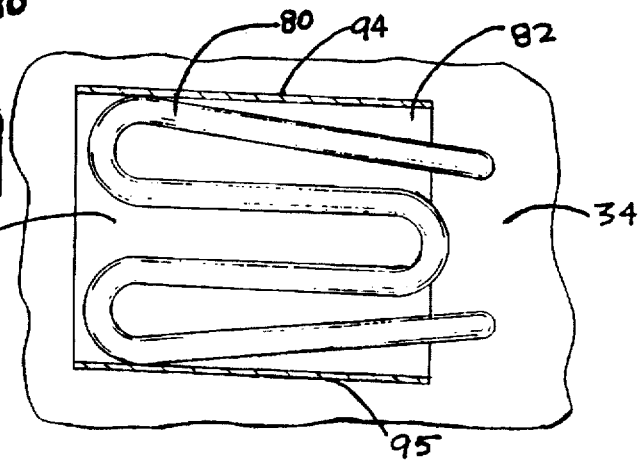
FIG. 9

CURLING IRON STOVE WITH INTERNAL CAVITY WITH ELECTRIC HEATER POSITIONED THEREBELOW

This is a continuation-in-part of application Ser. No. 08/103,987 filed on Aug. 10, 1993, now abandoned.

BACKGROUND OF THE INVENTION

This invention relates to heating thermal irons used to curl hair and a specially effective stove made for that purpose that is significantly superior to other such stoves.

Curling iron stoves prior to this invention were often dangerous to use and inefficient in operation, thus costly relative to the distinctions in accordance with this invention.

In order to get the interior heating area for curling irons hot enough for practical use the outside of prior art stoves became too hot to touch and could easily burn a user.

The back of the heating chambers were often open and would tend to crack nearby mirrors or cause other accidents. Such stoves were clumsy in operation and aesthetically ugly.

Moreover, the prior art heating components were limited in capability, lacking easy temperature adjustment, inefficient and unreliable.

The stove cases, intended to support irons seldom held irons steadily and were subject to tipping and dangerous spilling of hot irons.

In addition, the cases lost a great deal of heat during use permitting a highly inefficient loss during operation.

To solve these and other problems the stove in accordance with this invention was developed.

Thus, the stove in accordance with this invention solves many of the problems in prior art stoves by creating a differently structured stove using unique components and materials which provides much greater efficiency, safety, versatile control operation,wrapped up in a very attractive shape and style, and numerous other advantages that become apparent during use.

SUMMARY OF THE INVENTION

This stove, specially adapted for heating curling irons, includes a curved outer case which surrounds an internal cavity member within which curling irons, which are to be heated, are placed. The internal cavity member has an inlet into the case through which curling irons are inserted for heating.

A tubular heating element is contained within the case in a position to heat curling irons contained within its cavity member. A temperature controller is connected to the heating element so as to be able to infinitely adjust it within the desired temperature range.

Special insulation is provided,which is uniquely placed within the case,so that it causes the outside temperature of the case to be maintained at a low enough temperature that accidental burning of a user's hands is avoided. The curling irons are thermally heat responsive, positioned on the floor of the cavity member with the heating element only under this floor immediately adjacent to the curling irons and remotely displaced from the upper sides and top of the case.

DESCRIPTION OF THE DRAWINGS

FIG. 1 is a side elevational view of a stove case, support and surrounding ring, in accordance with this invention.

FIG. 2 is a top plan view of stove as shown in FIG. 1.

FIG. 3 is a bottom plan view of the stove as shown in FIG. 1.

FIG. 4 is a front elevational view of the stove as in FIG. 1 showing an entry cavity member for the heating of curling irons.

FIG. 5 is a rear elevational view of the stove as in FIG. 1.

FIG. 6 is a cross-sectional view of the stove taken through the plane of 6—6 in FIG. 1, including a tubular heating element held below the cavity member.

FIG. 7 is cross-sectional view of the stove taken through the plane of 7—7 in FIG. 6, including a side elevational view of a heating element held below the cavity member in which irons to be heated are held.

FIG. 8 is a fragmented, partly sectioned, top plan view of the tubular heating element as shown in section and side elevation in FIGS. 6 and 8, respectively.

FIG. 9 is a front elevational view of the stove open front as in FIG. 4 showing the modification, in phantom lines, of FIG. 8, wherein the scissors are shown in cross-section at the stove internal cavity member entry opening, wedged into, and held in an implement holder angled downwardly from a vertical slot opening cut through the plate modification which is mounted across the front of the stove.

DESCRIPTION OF A PREFERRED EMBODIMENT OF THE INVENTION

An example of a stove in accordance with this invention is shown in the drawings wherein the case 30 is formed as a rounded edge, flattened top and bottom structure with a cavity member 50 therein defining a chamber having an entry opening 52 suitable for receiving curling irons to be heated therein.

Extending centrally around the sides of the case 30 is a ring 60 which extends down below and in front of the cavity member entry-opening 52 to form a curling iron rest 62.

The case 30 is mounted on a base 70 which extends down to a mounting plate 72 wide enough to prevent tilting of the stove in use thus preventing accidental tipping. The base 70 is preferably sloped more to the front than the back in order to better accommodate switches and connections and to provide a better aesthetically balanced look.

The base 70 supports the case 30 in a position that the cavity member 50 is angled upwardly (preferably about 7' relative to the mounting plate 72) so that curling irons heated therein will not fall out.

In order to heat the stove cavity member 50 and curling irons placed therein an electrical tubular heating element 80 is secured adjacent to cavity member 50. Heating element 80 is held in place by a heating element strap 82 which forms a bracket which is attached to the case 30.

As shown a preferred tubular heating element is formed as a sharply curved triple-U shape in one plane with electrically conductive connectors extending down perpendicularly thereto through openings in the case for connection with a suitable power source.

The tubular heating element 80 includes a resistance component 84, such as a spiral wound nickel-chrome wire, axially centered within a heater sheath 86 which is electrically insulated, for example by surrounding compacted magnesium oxide powder, and having a suitable metallic exterior cover 88. A suitable diameter for the heating element 80 is one-quarter inch.

The materials of the heating element are specially selected and manufactured so that bending to preferred curved shapes, such as the illustrated multiple, narrow-U (three loops for 120 voltage) can be facilitated without damage.

Terminals, such as 90, on the open ends of the heating element 80 on the portions thereof 92, perpendicularly extend down from the plane of the curved, narrow-U portion, so that resistance component 84 can connect with and form a controllable electrical circuit with connectors, such as 100.

Within the space 32, formed between the inside of the case 30 and the outside of the cavity member 50,insulation is placed which is sufficient to allow touching the outside of the case without immediate burning of a user's hands even though the heating element 80 is hot enough to quickly raise the temperature of the cavity member floor 54.

Preferably the insulation is specially vacuum-formed to fit in space 32, made of refractory ceramic fiber, such as aluminum silicate fiber insulation Refractory Products Company 2100-L. Such an insulation will keep the outside temperature of case 30 low enough to prevent burning, but allowing the interior heating element temperature to be high enough to cause quick heating cavity member 50 without significant damage to components and presenting a very favorable efficiency of operation.

Preferably, the tubular heating element 80 is held by the strap 82 inside the case 30 just below and adjacent to the cavity member floor 54 of the cavity member 50. The length of the tubular curving heating element 80 is such that it extends substantially beneath all of the length of cavity member floor 54.

The width of heating element 80, which has a narrow, triple-U shape, extends about the full width of the cavity member floor 54 so that if a thermal (heat responsive) because it is held on the cavity member floor 50 just above heating element 80 and can be heated by it curling iron such as 90 (shown partly in phantom lines in FIG. 7) is placed therein, heating is maximized.

A temperature controller 102 with an exterior movable control means for preselected range of adjustments preferably is connected into the circuitry 100 of the heating element 80 so as to allow the user to infinitely adjust the temperature of the heating element 80 and the adjacent stove cavity member 50. Also, an on-off switch 104 with an indicator pilot light 106 is preferably included in the heating element circuitry 100.

It is preferable to have the tubular heating element adjacent to and only beneath the bottom floor of the internal cavity member. For significantly enhanced results it is necessary that the heating element be primarily only under the floor immediately adjacent a thermal iron to be heated.

The stove is structured and shaped to maximize its efficiency and attractive appearance in use wit h beauty shop equipment. Thus, the case 30 is flattened on its top and bottom and rounded smoothly on its edges to present a pleasing shape. The stove is compacted as much as practicable so that an operative embodiment has a case 30 that is about 6 inches long, 5 and ¼ inches wide and 4 and ½ inches in height from top to bottom.

The curling iron heating cavity member formed within the case, but spaced from the outside thereof, is roughly centered therein with a somewhat flattened ellipsoid shape conforming, (to a certain extent) to the outside shape of case 30. That is, as a suitable example the cavity member 50 bottom floor 54 and top ceiling 56 are ,respectively, roughly 3 and ¼ wide and 1 and ½ in height and extends from its ellipsoid shaped entry-opening 52 uniformly about 4 and ½ deep into case 30 to terminate at a cavity member end wall 58.

The curling iron rest 62 extends laterally in front of cavity member entry 52 slightly above the level of cavity member floor 54 so that if a curling iron 90 is placed therein it is held at a sufficient upward angle that it will not accidentally fall out and, at the same time, the outwardly extending handle can be readily grasped for use. This provides a very solid, rigid support since the rest 62 is a forwardly extending portion of ring 60 which encircles and is secured around the middle of case 30.

The strap 82, for holding tubular heating element 80, is formed as a bracket, in this example, with a flat floor 93 about 3 inches long, 2 inches wide and ¼ of an inch deep attached by longitudinal side walls 94 and 95, extending up, respectively, from each edge thereof, under the bottom of cavity member floor 54.

The insulation is selected so that the outside temperature of the case 30 does not get overly hot, which permits a user's brain to react quickly enough to prevent burning even though the internal heat element 80 may be as hot as 1500° F.

The heating chamber cavity member 50 is preferably lined with a special austenitic chrome and nickel alloy, such as 304 Stainless Steel. This reduces deterioration due to elevated temperatures and also provides a smooth sliding surface for irons placed therein to minimize wear.

To coordinate with and solidly support a stove of the size previously indicated the bottom 34 of the case 30 is mounted on the top of a base 70 which holds the cavity member floor 54 angled slightly longitudinally upward toward its open cavity member entry 52.

The open end portions 92 of a tubular heating element 80, when held in this strap 82 extend down through respective openings 96 in the bottom of case 34 to make electrical control and power connections within a hollow space in base 70.

Base 70 extends to form a flat mounting plate 72 which has non-slide feet 77, at each of its bottom corners. The mounting plate 72 is +e,fra 5+ee and ½ inches wide and long enough to prevent tipping during use. A bottom plate 73, as shown in FIG. 3 covers the open space under mounting plate 72 and is vented with laterally spaced louvered multiple slots 75.

As a modification of this invention the stove optionally, can be used to precisely heat cutting implements, such as are used to cut hair.

In order to ideally heat hair-cutting implements, like scissors 102, openings are provided in a holding bracket, like a plate 106 secured over the entry opening 52 into the the internal cavity member 50 sufficient to allow its cutting end 112 to be inserted into this heating cavity member 50.

The cutting end 112 is suspended in mid-air within cavity member 50 and held therein-by the shape of entry opening 104 in plate 106 so that such a cutting implement may be precisely heated by the controllable temperature within the internal cavity member 50.

Due to the infinite number of temperatures attainable by the stove, it may be used as a heater of hair cutting shears for the purpose of controlling split hair. Modification is needed, consisting of a structure which would keep the blades of the hair cutting shears in the air in the atmosphere of the stove cavity member as to attain a uniform temperature through heat convection on the blades without the possibility of damaging shear's hardness and the sharpness of the cutting edge (if blades touch cavity member walls, transfer of heat from stove to shears would be through conduction and no uniform temperature would exist on them).

The temperature that the shears should attain is between 170° C. to 220° C. for the hair to be cut and sealed. Depending on the texture of hair, higher or lower temperatures may be necessary, all of which can be attained with the stoves unique infinite temperature control and uniform atmosphere temperature.

Though a particular form is shown and described as a preferred operature embodiment of this invention the boundaries and forms of this invention are not meant to be limited thereby, but to comprehend and extend to all modifications within the spirit of the claims.

What is claimed is:

1. A thermal curling iron stove including:

an encapsulating outer case having an upper outside surface and an inside internal cavity member formed with a bottom floor adapted to hold at least one thermal iron adjacent to an interior surface of said cavity member on said bottom floor;

an electrical, tubular heating element carried within said case controllably capable of heating thermal irons positioned within said internal cavity member, said heating element having internal resistance wiring which is only beneath said floor and carried immediately adjacent only where irons to be heated are held;

sufficient insulation carried within said case between said upper outside of said outer case and said internal cavity member to keep said outer surface temperature of said case low enough to prevent burning a user's hands if touching said outer surface of said case remote from said heating element;

even at 1500 degrees Fahrenheit, whereby a thermal iron held by said internal cavity is heated by said heating element;

and temperature controller means connected to said tubular heating element capable of changing temperature in said cavity member so as to be able to quickly raise the temperature of said cavity member adjacent to a thermal iron placed therein while minimizing the temperature of said outer case remote from where a thermal iron As carried during heating;

said tubular heating element adjacent to and only beneath said bottom floor of said internal cavity member within said case wherein said internal cavity member is spaced from said upper outside surface of said outer case to create an insulation space for heat control and heat insulation is contained within said space wherein said stove is compact and portable and its said internal member has an entry opening terminating at a remote end wall said case is supported by a base which inclines said bottom floor of said cavity member down away from said entry opening toward said end wall when said base is placed on a horizontal surface, a curling iron rest support integrally formed as a part of said stove, said support extending forward from said stove around, and in front of, said internal cavity opening entry member in a position to support the handle of a curling iron placed thereon so that said iron portion to be heated will be tilted downwardly in said internal cavity member from said entry opening, wherein said heat insulation space, above said internal cavity member's upper surface and the top outer surface of said case, is enlarged sufficiently to accommodate special heat insulation material capable of reducing intense, extreme heat generated by special heating elements positioned below said internal cavity member, wherein said heat insulation in said heat insulation is special high temperature refractory ceramic fiber, and wherein said heating element under said internal cavity member is a tubular element capable of quickly generating high temperatures up to 1500 degrees Fahrenheit.

2. A curling iron stove as define in claim 1 wherein said curling iron rest is substantially U-shaped with the open ends of said U attached to said stove and extended around the sides of said entry opening of said internal cavity member.

3. A thermal curling iron stove as defined in claim 1 wherein;

there is an opening into said internal cavity member;

a cutting implement holding bracket is secured over said opening positioned to hold and suspend, in mid-air, without touching any other surface, a cutting implement having a cutting end held within said cavity member member, so that said cutting end can be heated to attain a uniform temperature through heat convection, without damaging said cutting end's desired cutting ability.

* * * * *